US005324417A

United States Patent [19]

Harandi

[11] Patent Number: 5,324,417

[45] Date of Patent: Jun. 28, 1994

[54] PROCESSING WASTE OVER SPENT FCC CATALYST

[75] Inventor: Mohsen N. Harandi, Langhorne, Pa.

[73] Assignee: Mobil Oil Corporation, Fairfax, Va.

[21] Appl. No.: 66,641

[22] Filed: May 25, 1993

[51] Int. Cl.[5] ..... C10G 11/00; C10G 9/02

[52] U.S. Cl. ..... 208/113; 208/126; 208/427; 208/13

[58] Field of Search ..... 208/85, 89, 113, 120, 208/73, 211, 210, 91, 92, 131, 13, 86, 50, 80, 48 Q, 161, 226, 113, 126, 427; 585/412

[56] References Cited

U.S. PATENT DOCUMENTS 4,048,057 9/1977 Murphy ..... 208/89
4,414,098 11/1983 Zandona et al. ..... 208/120
4,436,613 3/1984 Sayles et al. ..... 208/74
4,601,814 7/1986 Mauleon et al. ..... 208/113
4,786,401 11/1988 Jacob et al. ..... 208/85

*Primary Examiner*—R. Bruce Breneman
*Assistant Examiner*—Bekir L. Yildirim
*Attorney, Agent, or Firm*—Alexander J. McKillop; Malcolm D. Keen; Richard D. Stone

[57] ABSTRACT

Distress feeds, such as refinery sludge and slop oils are upgraded over hot equilibrium catalyst (E-Cat) removed from an FCC regenerator. Hot E-Cat demetallizes and/or demulsifies slop and sludge streams in an auxiliary reactor without contaminating the FCC catalyst inventory. Waste streams are upgraded with a "waste" catalyst stream. The auxiliary reactor and FCC reactor may share a product fractionator.

8 Claims, 2 Drawing Sheets

PROCESSING WASTE OVER SPENT FCC CATALYST

FIELD OF THE INVENTION

This invention relates to fluid catalytic cracking and cleanup of waste streams such as slop oils, spent caustic, spent DEA, spent activated carbon, spent resins, refinery sludges and the like.

BACKGROUND OF THE INVENTION

Many refineries devote extraordinary amounts of energy and operating expense to convert most of a whole crude oil feed into high octane gasoline. The crude is fractionated to produce a virgin naphtha fraction which is usually reformed, and a gas oil and/or vacuum gas oil fraction which is catalytically cracked to produce naphtha, and light olefins. The naphtha is added to the refiners gasoline blending pool, while the light olefins are converted, usually by HF or sulfuric acid alkylation, into gasoline boiling range material which is then added to the gasoline blending pool.

Catalytic cracking started as a fixed bed process, then evolved to a moving bed process, and finally a fluid bed process, with considerable competition and overlap as each improvement displaced earlier cracking processes. The fluid bed process itself underwent considerable evolution, going from a long folded riser cracking with limited conversion and 10–60 seconds of residence time, to dense bed cracking with increased conversion and residence time, to riser cracking with 1–10 seconds of residence time.

The fluid catalytic cracking (FCC) process is now the preferred process in the petroleum refining industry for converting higher boiling petroleum fractions into lower boiling products, especially gasoline. A finely divided solid cracking catalyst promotes cracking reactions. The catalyst is in a finely divided form, typically with a particles of 20–100 microns, with an average of about 60–75 microns. The catalyst acts like a fluid (hence the designation FCC) and circulates in a closed cycle between a cracking zone and a separate regeneration zone.

In FCC, fresh feed contacts hot catalyst from the regenerator in a reactor. The cracked products are discharged and separated and cracking reactor vapor sent to a main fractionator which produces several product streams. The catalyst is regenerated, and reused.

Depending on the size of the unit, from a few tons to 50 or 60 tons per minute of regenerated catalyst meets feed in the reactor. Each day most units remove a few to about 50 tons of catalyst from the unit, and usually refer to it as E-cat, or equilibrium catalyst, and replace it with fresh or makeup catalyst. As feeds get worse, catalyst removal and makeup rates usually increase, primarily because of metals contamination.

A further description of the catalytic cracking process may be found in the monograph, "Fluid Catalytic Cracking With Zeolite Catalysts," Venuto and Habib, Marcel Dekker, N.Y., 1978, incorporated by reference.

Modern refiners are faced with several dilemmas. They must process large amounts of crude oil, frequently containing so much metal that the spent catalyst becomes a disposal problem. Large refineries also generate significant amounts of slop or sludge streams which are very small in terms of crude throughput, but so contaminated with metals and solids that processing of the slop streams is difficult. As an example, many refinery sludges contain so much metal and/or solids that they cannot be cracked in the FCC unit, but these same sludges contain a lot of potentially recoverable hydrocarbon.

In addition, refineries produce other hazardous waste streams such as spent caustic, various spent amine solutions (diethanolamine, DEA and/or methanolamine, MEA). Spent caustic solutions are now hauled away at great expense. It is difficult to even concentrate some of these streams because of corrosiveness and/or fear of plugging equipment with salts.

Activated carbons and various resin catalysts and other absorbents are used in many refineries, and all of these materials become contaminated with metals and/or hydrocarbons during use. They represent another large, and expensive, disposal problem.

I discovered an efficient way to upgrade these waste refinery streams, by making unusual use of another by-product of a refinery, the tons per day of equilibrium catalyst removed from the FCC unit. Catalyst which must be removed from the FCC unit, usually because it has too much metal on it, makes an efficient slop oil upgrader with a large capacity for metals and solids.

In a preferred embodiment, I use not only the adsorbent value of the catalyst, but also make productive use of its thermal energy for upgrading waste streams. Thus, a spent caustic stream can be discharged at relatively low temperature into a vessel containing hot E-Cat. The caustic will be neutralized on the acid sites of the FCC catalyst, which reduces the acidity of the FCC catalyst. Water in the spent caustic is recovered as steam, while hydrocarbons and/or sulfur compounds are generally recovered as hydrocarbon vapor products or H2S. The spent caustic can be added at a relatively low temperature, because the hot FCC catalyst efficient heats even cool caustic streams. The net effect of all this is to make the caustic disappear, and reduce the acidity of the spent FCC catalyst. A waste stream has been eliminated, and the FCC catalyst is no more difficult to dispose of after eliminating the spent caustic Many refinery solid and liquid streams can be eliminated in this way, using spent FCC catalyst as a treating medium.

BRIEF SUMMARY OF THE INVENTION

Accordingly, the present invention provides a process for upgrading distress feed comprising a solids, metals, or water contaminated hydrocarbon feed which is more difficult to process in a conventional, heat balanced fluidized catalytic cracking (FCC) unit than a gas oil or vacuum gas oil feed and for simultaneously upgrading a conventional FCC feed comprising hydrocarbons having a boiling point above about 650° F. in an FCC process wherein said FCC feed is catalytically cracked to lighter products by contact with a circulating inventory of E-Cat, equilibrium fluidizable catalytic cracking catalyst particles having a size ranging from about 20 to about 100 microns, comprising catalytically cracking said FCC feed in an FCC reactor operating at catalytic cracking conditions by contacting feed with a source of regenerated E-Cat to produce an FCC reactor effluent mixture comprising cracked products and spent E-Cat containing coke and strippable hydrocarbons; separating said effluent mixture to produce a cracked product rich vapor phase and a solids rich phase of spent E-Cat and entrained and absorbed hydrocarbons; removing said cracked product rich vapor phase as a product of the FCC process; stripping said spent E-Cat in a stripping means to produce stripped E-Cat; regenerating said stripped E-Cat in an FCC catalyst regeneration means at catalyst regeneration conditions to produce regenerated E-Cat having a temperature of 1100° to 1500° F.; and recycling an amount of regenerated FCC catalyst to said FCC reactor from said regeneration means; removing from said FCC catalyst regeneration means a stream of regenerated E-Cat, in an amount less than 1% of the amount of regenerated E-Cat recycled to said FCC reactor, and charging said removed E-cat to an auxiliary reactor which is isolated from said FCC reactor; charging said distress feed to said auxiliary reactor at conversion conditions including a temperature above 500° F. and residence time sufficient to vaporize and/or convert a majority by weight of the hydrocarbon content of said distressed feed into a vapor product which is removed from said auxiliary reactor.

In another embodiment, the present invention provides a method of disposing of spent, aqueous, alkaline streams including spent caustic or spent amine solutions comprising charging to a neutralization reactor equilibrium catalyst (E-Cat) withdrawn from a fludized catalytic cracking unit and having acidic sites; maintaining said E-Cat as a fluidized bed in said reactor at a temperature of at least 250° F.; charging to said neutralization reactor said spent aqueous alkaline; exothermically reacting said aqueous alkaline stream with said E-Cat to vaporize and neutralize said alkaline stream and produce steam as a vapor phase product and at least partially neutralized E-Cat as products of said process.

In another embodiment the present invention provides a method of converting disulfides to H2S comprising: charging to a disulfide conversion reactor equilibrium catalyst (E-Cat) withdrawn from a fludized catalytic cracking unit; maintaining said E-Cat as a fluidized bed in said reactor at a temperature of at least 500° F.; charging to said conversion reactor a liquid hydrocarbon stream comprising at least 10 wt % disulfides; converting at least a portion of said disulfides to H2S; recovering a vapor stream containing H2S as a product of the process.

In yet another embodiment, the present invention provides a method of disposing of solid waste comprising charging to a waste conversion reactor equilibrium catalyst (E-Cat) withdrawn from a fludized catalytic cracking unit; maintaining said E-Cat as a fluidized bed in said waste conversion reactor at a temperature of at least 500° F.; charging to said reactor said solid waste; converting said solid waste by decomposition or combustion in said fluidized bed of E-Cat to eliminate said solid waste.

DETAILED DESCRIPTION

Figure 1:
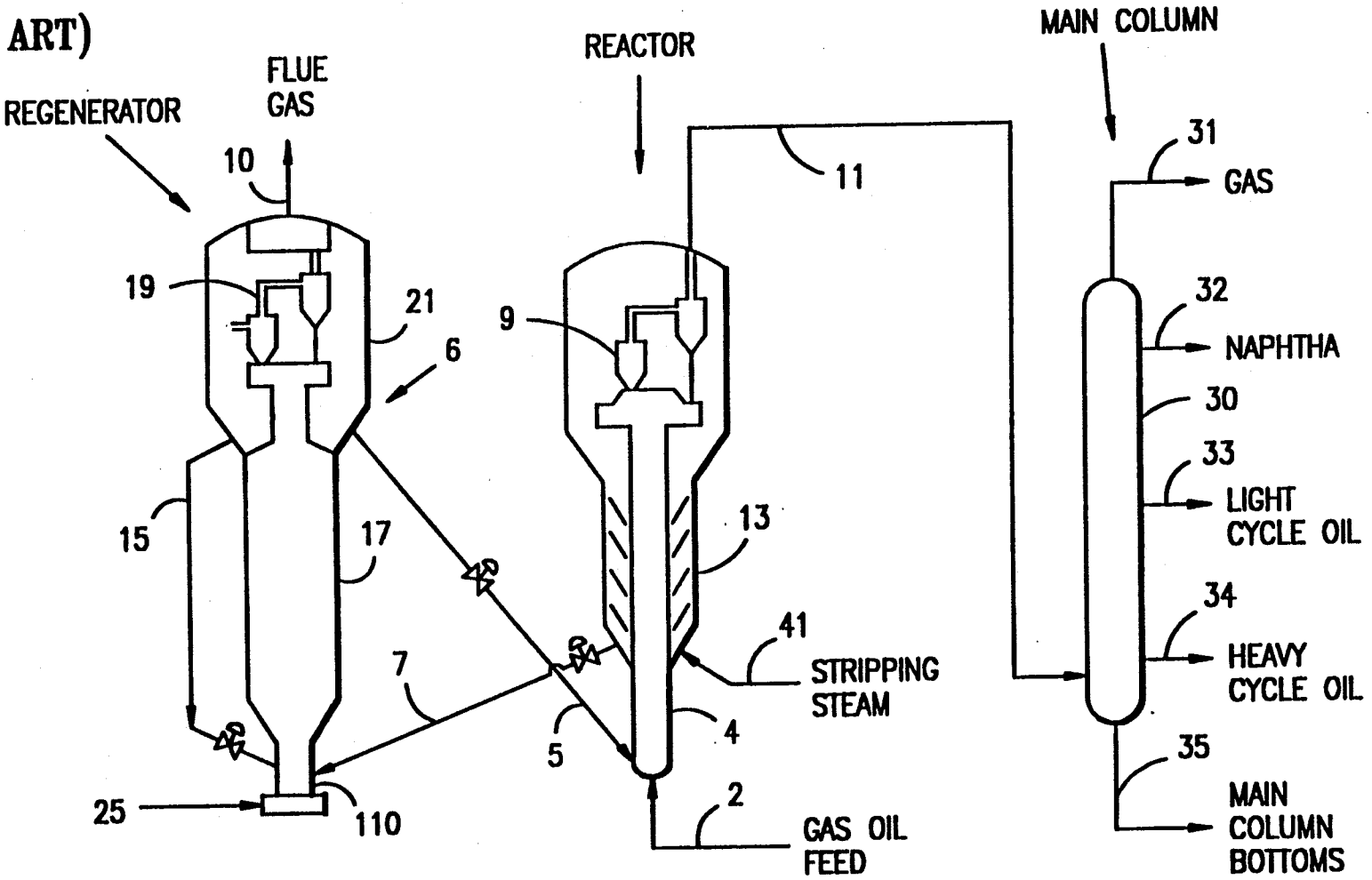
FIG. 1 (PRIOR ART)
FIG. 1 (prior art) is a simplified schematic view of an FCC unit of the prior art.

The present invention can be better understood by reviewing it in conjunction with a conventional riser cracking FCC unit. FIG. 1 illustrates a fluid catalytic cracking system of the prior art. It is a simplified version of FIG. 1 of U.S. Pat. No. 4,421,636, incorporated by reference.

A heavy feed, typically a gas oil boiling range material, is charged via line 2 to the lower end of a riser cracking FCC reactor 4. Hot regenerated catalyst is added via conduit 5 to the riser. Preferably, some atomizing steam is added, by means not shown, to the base of the riser, usually with the feed. With heavier feeds, e.g., a resid, 2–10 wt. % steam may be used. A hydrocarbon-catalyst mixture rises as a generally dilute phase through riser 4. Cracked products and coked catalyst are discharged from the riser. Cracked products pass through two stages of cyclone separation shown generally as 9 in the figure.

The riser 4 top temperature, which usually is close to the temperature in conduit 11, ranges between about 480° and 615° C. (900° and 1150° F.), and preferably between about 510° and 595° C. (950° and 1050° F.). The riser top temperature is usually controlled by adjusting the catalyst to oil ratio in riser 4 or by varying feed preheat.

Cracked products are removed from the FCC reactor via transfer line 11 and charged to the base of the main column 30. In some refineries, this column would be called the Syncrude column, because the catalytic cracking process has created a material with a broad boiling range, something like a synthetic crude oil. The main column 30 recovers various product fractions, from a heavy material such as main column bottoms, withdrawn via line 35 to normally gaseous materials, such as the vapor stream removed overhead via line 31 from the top of the column. Intermediate fractions include a heavy cycle oil fraction in line 34, a light cycle oil in line 33, and a heavy naphtha fraction in line 32.

Stripping steam is added via line 41 to recover absorbed and/or entrained hydrocarbons from spent catalyst. Stripped catalyst is removed via line 7 and charged to a high efficiency regenerator 6. A relatively short riser-mixer section 110 is used to mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 10.

The FCC unit described above uses a high efficiency regenerator, but many use regenerators with a single bubbling dense bed of catalyst. A few regenerators use two bubbling dense beds. All regenerators have means, not shown, for adding fresh catalyst and withdrawing equilibrium catalyst. Catalyst can be removed from, or added to, just about any point in the FCC unit. Almost all refiners restrict catalyst traffic, in or out, to the regenerator. Catalyst removed from the regenerator will be clean burned, so that it does not represent a fire hazard. Fresh catalyst, or makeup catalyst, is usually added to the regenerator for final calcining and to dilute the high activity of a few tons of makeup catalyst in hundreds of tons of E-cat in the regenerator.

Catalyst removed from the regenerator is at the temperature of the regenerated catalyst, typically 1250° to 1350° F., though some of the two stage regenerators may have catalyst temperatures in the 1400° to 1500° F. range.

Figure 2:
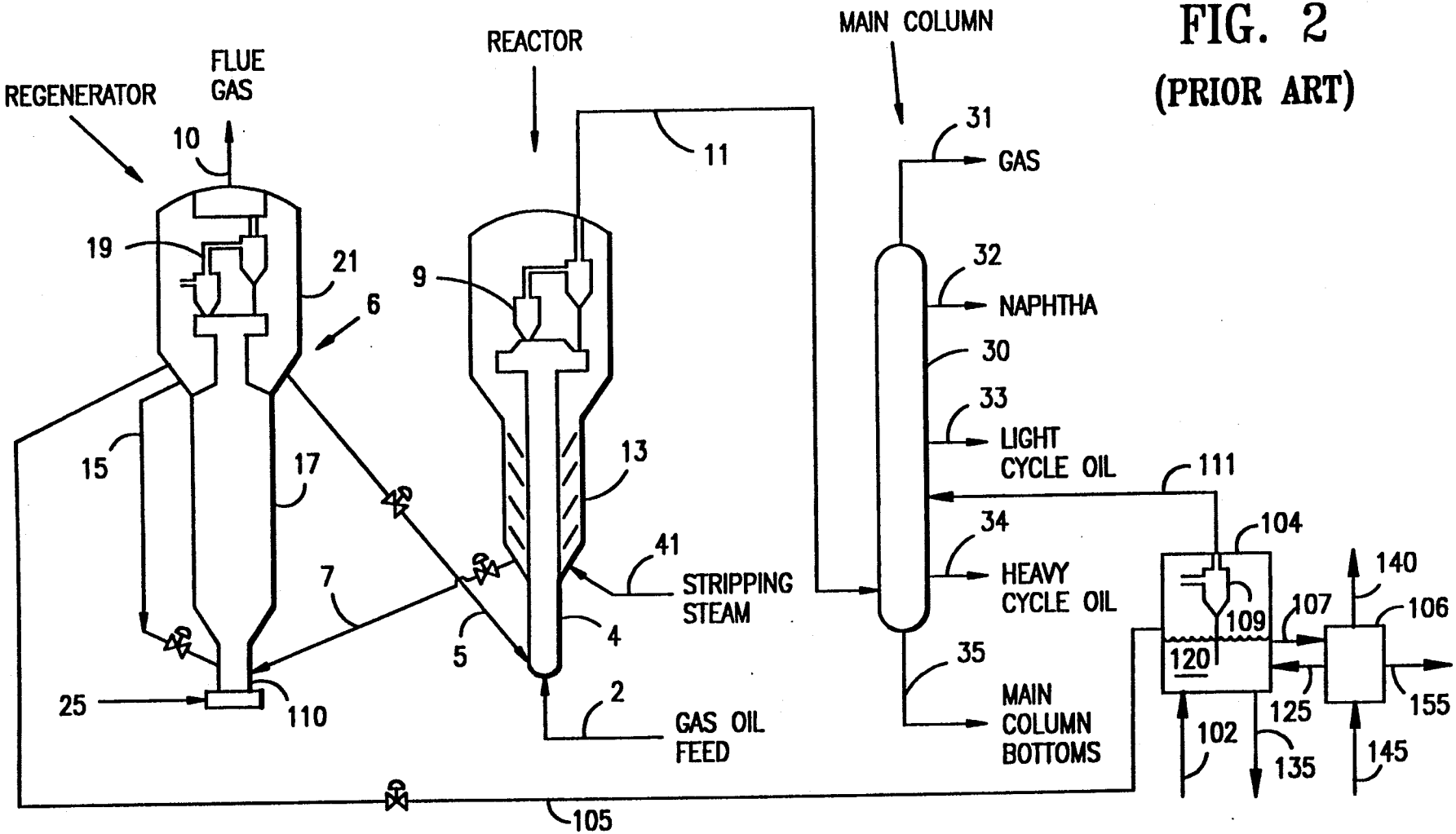
FIG. 2 (PRIOR ART)
FIG. 2 (prior art) is a simplified schematic view of an upgrading reactor with its own regenerator, but sharing the FCC main column.

FIG. 2 shows a simplified, schematic view of a slop oil upgrading reactor using E-Cat withdrawn from an FCC unit such as that shown in FIG. 1. The upgrading reactor uses the FCC main column for product fractionation and has a regenerator associated with the upgrading reactor.

Hot regenerated catalyst is removed from the regenerator via line 105 and charged to upgrading reactor 104. The catalyst is maintained as a bubbling dense bed 120 in vessel 104. Slop oil, or a resid fraction, is charged via line 102 to a lower portion of bed 120. Slop oil may also be added to line 105, by means not shown. Cracked products and catalyst are separated in cyclone separation means 109, with recovered catalyst returned to bed 120 via the cyclone dipleg and cracked, decontaminated products charged via line 111 to the FCC main column 30.

In the embodiment shown, there is a sufficient amount of slop oil or resid in line 102 relative to removed E-cat in line 105 to justify use of an auxiliary regenerator 106. Some catalyst is withdrawn from reactor 104 via line 107 and regenerated in regenerator 106 by the addition of an oxygen containing gas via line 145. Flue gas is removed via line 140, and regenerated, contaminated catalyst returned via line 125 to upgrading reactor 104. Catalyst is withdrawn from either upgrading reactor 104 via line 135 or auxiliary regenerator 106 via line 155 for disposal or metals recovery.

DETAILED DESCRIPTION OF PREFERRED EMBODIMENTS

Having provided an overview of the process and apparatus of the invention, more details will now be provided about the FCC process and the upgrading reactor.

FCC Feed

Any conventional FCC feed can be used. The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been cracked.

Preferred feeds are gas oils, vacuum gas oils, atmospheric resids, and vacuum resids. Most feeds will have an initial boiling point above about 650° F.

Slop/Oil Resid Feed

The upgrading reactor of the present invention provides the most benefit when it handles stocks too contaminated or difficult for processing in the conventional FCC unit.

Refineries and tank farms inherently produce some small streams with concentrated levels of contaminants. Pumps leak and compressors lose lubricating oil—such streams are collected, usually in an API separator, for water removal and disposal. These streams frequently contain large amounts of entrained solids such as coke fine and liquid contaminants.

Interfaces in refinery vessels gather trash and particulates. Frequently these form stable emulsions which are periodically drawn off from refinery vessels for disposal.

Sludge forms and accumulates in the bottom of storage tanks. Some is rust and scale from tankers and pipelines, while some is an oxidation product, or the result of operating a visbreaker at too high a severity.

Many of these streams could be fed to a coker, however, addition of too many waste streams there can significantly reduce coker capacity and/or cycle length. Processing waste over spent FCC catalyst can provide a significantly higher value uplift, and some synergism. Many refineries do not have a coker, and need a convenient way of dealing with slop streams short of sending them to a hazardous waste landfill.

Slop oil streams, waste oil, sludges pumped out of tanks or from tankers, and similar materials may safely be added to the auxiliary reactor without affecting the FCC reactor.

When the upgrading reactor shares the FCC main column fractionator the slop streams are preferably added continuously or slowly to minimize disruption of the FCC main column.

One interesting application of my process use of the upgrading reactor to crack the worst fractions of the FCC feed. Charging a cleaner feed to the FCC unit, and a dirtier feed to the auxiliary reactor, such as vacuum resid, or a metals rich fraction from a solvent deasphalting unit, allows the FCC unit to crack a better feed and double use of the FCC catalyst. Distress stocks may be catalytically- cracked rather than coked.

Thus the upgrading reactor is especially useful for processing stocks containing large amounts of non-distillable materials, e.g., 5 or more wt % Conradson carbon residue (CCR) material, and with large amounts of Ni and/or V.

FCC Catalyst

Commercially available FCC catalysts may be used. The catalyst usually contains large amounts of large pore zeolite. Preferred catalysts for use herein will usually contain at least 10 wt % large pore zeolite in a porous refractory matrix such as silica-alumina, clay, or the like. The zeolite content is preferably much higher than this, and should usually be at least 20 wt % large pore zeolite.

Conventional zeolites such as X and Y zeolites, or aluminum deficient forms of these zeolites such as dealuminized Y (DEAL Y), ultrastable Y (USY) and ultrahydrophobic Y (UHP Y) may be used as the large pore cracking catalyst. The zeolites may be stabilized with Rare Earths, e.g., 0.1 to 10 wt % RE.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1-12, and typified by ZSM-5, and other materials having a similar crystal structure). Additives for CO combustion, or SOx capture may also be present. The FCC catalyst composition, per se, forms no part of the invention.

Upgrading Reactor Catalyst

The upgrading reactor catalyst is simply equilibrium catalyst removed from the FCC unit.

In a typical FCC unit, about 5 tons per day of catalyst is removed to maintain catalyst activity and/or deal with metals buildup on catalyst.

The upgrading reactor may also have some metal scavenging additive present, either by virtue of passing through the FCC unit or being added intermediate the FCC unit and/or the upgrading reactor.

FCC Reactor Conditions

Conventional cracking conditions may be used. Typical riser cracking reaction conditions include a catalyst/oil weight ratios of 1:1 to 10:1, and a hydrocarbon residence time of 1–10 seconds. Most operate with reactor outlet temperatures of 950°–1050° F. Conventional all riser cracking FCC units, shown in U.S. Pat. No. 4,421,636, incorporated, by reference, may be used.

It is preferred, but not essential, to rapidly separate spent catalyst from cracked products discharged from the reactor. Use of a cyclone separator, or other inertial separator will help separate coked catalyst from cracked products.

Upgrading Reactor Conditions

The upgrading reactor has an unusually wide range of suitable operating conditions, because the reactor can be called on to perform a variety of tasks. Several sets of operating conditions can be given, but all follow the constraints of sufficient temperature to vaporize at least a major portion of the feed and sufficient heat input to satisfy the heat of reaction feed vaporization.

Low severity upgrading conditions can involve vaporization and a modest amount of cracking of various refinery emulsion streams. Many refinery emulsions contain water, surfactants and relatively clean hydrocarbons. Refiners are reluctant to add a large slug of such feed to their cracking unit, but it can safely be charged to the upgrading reactor. As the feed is relatively light, the temperatures needed to maintain vapor phase conditions can be relatively low, on the order of 400° to 500° F. Preferably temperatures higher than this will be used to improve the quality of the cracked products. Higher temperatures produce higher octane gasoline, so temperatures of at least 600° to 700° F. are preferred, and most preferably about 900° F. or higher.

Higher severity upgrading, for processing tank sludges or residual fractions, requires higher temperature operation. The minimum reactor temperature when upgrading a resid fraction will be above 900° F., and preferably above 1000° F.

Much higher temperatures can be used, but I prefer to operate with a temperature no higher than that of conventional catalytic cracking unit, both to simplify metallurgical requirements and to avoid undue thermal cracking and thermally induced polymerization.

Residence time is almost as important a parameter as temperature. For thermal reactions, time and temperature must both be specified to define a reaction severity. For my process, catalytic rather than thermal reactions predominate, but time is still an important variable.

Preferably the vapor residence time will be at least five seconds, and typically will be from 5 seconds to 5 minutes. More preferably the vapor residence time will be about 1 minute.

Catalyst residence times may vary greatly. There really is no upper limit on catalyst residence time, but most refiners will not keep catalyst more than 3 days in the upgrading reactor. To minimize the size of the equipment, higher temperatures and shorter catalyst residence times will frequently be beneficial, such as a catalyst residence time of about 30 minutes.

Pressures may range from subatmospheric to 100 atm, but preferably are 5 to 500 psig, more preferably 10 to 30 psig. These are sufficient to reduce the volume of vapor product to minimize superficial vapor velocity, and are similar to conditions used in FCC units.

Slop oil and E-Cat contact may occur in a vertical upflow or downflow reactor, or slop oil may be added to a bubbling or turbulent or fast fluidized bed of E-Cat. To maximize use of E-Cat and to achieve maximum conversion, relatively long contact times are preferred, and relatively high catalyst density. Simply adding slop oil into a bubbling dense phase fluidized bed of E-Cat will provide an efficient way to upgrade the slop oil.

Cat:oil ratios may vary greatly. It will usually be preferred to operate with a large inventory of E-Cat in the slop oil reactor, and continuously add a small stream of slop oil. In refineries where the slop oil streams are small, and large amount of E-Cat are removed on a near continuous basis, it will be possible to operate without any external heat input to the slop oil reactor save for feed preheat. Thus, the addition of 10,000 #/day of E-cat at 1350° F. will permit the conversion of several thousand pounds of spent caustic per day.

Slop Oil Vapor Product Recovery

Simple and conventional product recovery means may be used. Some heat exchange with slop oil feed, or some other refiner stream may be used to effect initial cooling of the vapor product, then fin fan cooling or heat exchange with water, then vapor/liquid separation. There will usually be large amounts of water present, so a three phase separator will normally be used to produce a water stream, a normally liquid hydrocarbon product, and normally gaseous hydrocarbon product. Great purity is not required, the goal of the process is to clean up slop oil streams sufficiently so that they may be processed in other refinery units. In some refineries, especially those with large slop oil streams, it may be worthwhile to recover either a gasoline boiling range fraction or a C3/C4 fraction(s). The gasoline will be of moderate to high octane, depending on the temperature in the reactor, and the C3/C4 fractions will be highly olefinic and may be used to generate feedstreams for alkylation or etherification units.

Preferably the upgrading reactor operates at a pressure just slightly above that of the FCC main fractionator, so this vapor stream may be fed directly into that column. The FCC main fractionator can usually handle the amount of product associated with slop oil streams, the problem with the slop oil streams was that the FCC catalyst could not tolerate the metals/trash usually associated with such streams.

FCC Catalyst Stripping

Conventional stripping techniques can be used to remove strippable hydrocarbons from spent catalyst, usually contact with 1 to 5 wt % steam.

Auxiliary Catalyst Stripping

Although no stripper is shown, one may be used. Stripping will reduce the amount of sludge or emulsion sent to the auxiliary regenerator, but this feed is not very valuable. The benefit of stripping may not be worth the cost, or may justify only a modest amount of stripping, such as putting a steam line near the inlet to line 107.

Stripping may be essential if the upgrading reactor 104 is called on to upgrade a significant amount of resid or tarry fractions, which contain a large amount of high boiling material present in interstitial spaces or in the pores of the cracking catalyst. Such material might condense and cause materials handling problems if not removed before the catalyst is cooled for disposal.

FCC Catalyst Regeneration

The process and apparatus of the present invention can use conventional FCC regenerators. Most use a single large vessel, with a dense phase, bubbling fluidized bed of catalyst. High efficiency regenerators, with a fast fluid bed coke combustor, a dilute phase transport riser above it, and a second fluidized bed to collect regenerated catalyst, may be used. More details about several representative bubbling dense bed regenerators are presented below.

Swirl regenerators are disclosed in U.S. Pat. No. 4,490,241, Chou, and U.S. Pat. No. 4,994,424 Leib and Sapre, incorporated by reference.

A cross-flow regenerator is disclosed in U.S. Pat. No. 4,980,048 Leib and Sapre, incorporated by reference.

A regenerator associated with a stacked or Orthoflow type FCC unit is shown in U.S. Pat. No. 5,032,252 and U.S. Pat. No. 5,043,055 Owen and Schipper, incorporated by reference.

Auxiliary Catalyst Regeneration

An auxiliary catalyst regenerator, such as that shown in FIG. 2, is preferred but not essential. Operation without a regenerator permits recovery of all of the thermal energy in hot regenerated E-Cat withdrawn from the regenerator, but permits only limited use of the adsorbent and catalytic value of the E-Cat. Auxiliary catalyst regeneration of catalyst in vessel 104 allows maximum use to be made of the E-Cat.

Regeneration can be periodic or continuous. Periodic heating can be achieved by blocked operation of vessel 104. The auxiliary reactor can be periodically isolated, using valves not shown, from distress feed and product recovery facilities, and air or oxygen containing gas added to the reactor to the auxiliary reactor. This will burn coke and any hydrocarbon present from the catalyst, add heat, and restore catalyst activity.

Periodic regeneration may also occur in a relatively small vessel operating in blocked fashion. Some catalyst may be removed from the auxiliary regenerator, and charged to a regenerator vessel. The regenerator vessel may then be isolated, and stripped with steam, followed by addition of an oxygen containing gas to decoke the catalyst. The heated, decoked catalyst may then be intermittently returned to the auxiliary reactor.

Continuous regeneration with a separate catalyst regeneration facility such as that shown in FIG. 2 is preferred when maximum use of the auxiliary reactor for demetallation, or black oil conversion, is required. Continuous regeneration is also possible, though perhaps with some loss of potentially recoverable product, by simply adding air or an oxygen containing gas to one place in the reactor. Vertical mixing is very good in bubbling fluidized beds, but not good in a horizontal direction, so it is possible to add slop streams to one side of the reactor and air to the other side. This will produce a lot of low BTU vapor product, and may cause some afterburning, but it is one possible mode of operation.

If the geometry of the vessel permits, air or oxygen containing gas may be added to the bottom of the reactor vessel, with a waste stream added higher up. A somewhat vertical reactor vessel is preferred for such service.

In some cases regeneration will not be needed for heat, as when an exothermic reaction is conducted in the reactor. Thus when spent caustic solution is neutralized by reaction with hot, spent E-Cat, the heat of reaction will offset the heat of vaporization of water. Many alkaline waste streams are created in a refinery, including spent caustic and spent amine solutions. These streams are hard to convert or concentrate, because the temperatures needed, typically above 250° to 600° F., are not practical to achieve due to corrosion and/or other factors related to solids and contaminant handling. My process allows these streams to be disposed of in the reactor while producing useful heat in the reactor and neutralizing the FCC catalyst, making it easier to dispose of the FCC catalyst.

Lift Gas Generation

An unusual, and beneficial, use of the present invention is formation of a vapor phase product which can be used as a lift gas in an FCC riser reactor. Many refinery waste streams will produce a vapor product, after reaction with spent E-Cat, which is rich in steam and or light hydrocarbons. This vapor fraction may be used as lift gas, to replace steam which might otherwise be used as a lift gas in the riser. Any hydrocarbons present in the vapor product of the waste reactor will be further upgraded in the FCC riser.

DISCUSSION

The process of the present invention allows a waste stream (E-Cat removed from the FCC) to treat a waste stream and convert a disposal problem into valuable product.

The process permits isolation of the worst fraction of the refinery feed, and keeps these high risks feeds from contaminating the FCC catalyst, while using catalyst from the FCC to upgrade these feeds. Even more use can be made of the FCC unit, by using the FCC product recovery facilities to process the distress feed conversion reactor product vapors.

This is very different from the ART and similar processes, which use inert solids to demetallize resid fraction. I use FCC catalyst, and the products of my contacting step can be fully compatible with other cracked products. The ART process uses a circulating inert solid to remove CCR, metals, etc. from a resid feed and produce a demetallized heavy product which can be fed to a conventional FCC unit. My process is a parallel treatment, rather than a pre-treatment of FCC feed. My process effectively substitutes the auxiliary reactor for the FCC reactor, keeps the bottom of the barrel from the FCC reactor, but makes products with properties approaching those made in the FCC reactor.

For a refiner with a 50,000 BPD FCC unit, faced with disposal every day of 500 to 1000 BPD of slop and sludge streams, my process permits about 90 to 95% recovery of the hydrocarbon value of these slop streams without passing any of this material through the FCC. The sludge/slop oil disposal problem is eliminated, while disposal of E-Cat is no more difficult because of its brief tenure in the slop oil conversion reactor.

Refiners also have the option of taking some of the worst conventional feeds to the FCC, some of the resid and vacuum resid now fed to the FCC, and passing this material through the slop oil upgrading reactor. The high metals feeds will do their mischief on catalyst which has been removed from the FCC, rather than on equilibrium catalyst circulating in the FCC. This unloading of the worst fractions of the feed will become even more important as refiners process worse feeds which increases the amount of E-cat that must be removed daily to maintain catalyst activity or keep metals levels down.

The same feeds which create a metals problem cause high catalyst turnover producing copious amounts of E-cat, on the order of 2–3 up to even 5% per day of catalyst inventory, for use in a slop oil/resid upgrading reactor.

The process of the present invention gives refiners a flexible and powerful way to eliminate many waste streams. Spent caustic can be eliminated by spraying a stream of it into a bubbling fluidized bed of spent E-Cat at a low temperature, even as low as 250° F. The alkaline caustic reacts exothermically with the acid sites on the FCC catalyst, providing heat. The FCC catalyst is at least partially neutralized, making it easier to landfill. Similar results are achieved with spent amine solutions.

Solid resin catalysts streams can be eliminated by addition to a fluid bed of E-Cat at 500° F. or higher, with conversion to valuable cracked products. Spent activated carbon can be effectively converted by effective stripping in a hot bed of E-Cat and gradual combustion during continuous or intermittent regeneration of the E-Cat fluid bed.

Disulfide oil streams, such as those generated by treating or mercaptan conversion processes can now be effectively removed from the refinery waste stream. My auxiliary reactor will recover the hydrocarbon values associated with disulfide oil streams from treating units, and convert most of the disulfide sulfur into H2S, which can be efficiently converted into elemental sulfur in a Claus unit.

I claim:

1. A process for upgrading distress feed comprising a solids, metals, or water contaminated hydrocarbon feed which is more difficult to process in a conventional, heat balanced fluidized catalytic cracking (FCC) unit than a gas oil or vacuum gas oil feed and for simultaneously upgrading a conventional FCC feed comprising hydrocarbons having a boiling point above about 650° F. in an FCC process wherein said FCC feed is catalytically cracked to lighter products by contact with a circulating inventory of E-Cat, equilibrium fluidizable catalytic cracking catalyst particles having a size ranging from about 20 to about 100 microns, comprising:

a. catalytically cracking said FCC feed in an FCC reactor operating at catalytic cracking conditions by contacting feed with a source of regenerated E-Cat to produce an FCC reactor effluent mixture comprising cracked products and spent E-Cat containing coke and strippable hydrocarbons;

b. separating said effluent mixture to produce a cracked product rich vapor phase an da solids rich phase of spent E-Cat and entrained and absorbed hydrocarbons;

c. removing said cracked product rich vapor phase as a product of the FCC process;

d. stripping said spent e-Cat in a stripping means to produce stripped E-Cat;

e. regenerating said stripped E-Cat in an FCC catalyst regeneration means at catalyst regeneration conditions to produce regenerated E-Cat having a temperature of 1100° to 1500° F.; and f. recycling an amount of regenerated FCC catalyst to said FCC reactor from said regeneration means;

g. removing from said FCC catalyst regeneration means a stream of regenerated E-Cat, in an amount less than 1% of the amount of regenerated E-Cat recycled to said FCC reactor, and charging said removed E-cat to an auxiliary reactor which is isolated from said FCC reactor;

h. charging said distress feed to said auxiliary reactor at catalytic conversion conditions including a temperature above 500° F. and residence time sufficient to vaporize and/or convert a majority by weight of the hydrocarbon content of said distressed feed into a vapor product which is removed from said auxiliary reactor, and wherein said auxiliary reactor comprises a bubbling fluidized bed with isolated inlets for said distress feed and for an oxygen containing gas, and wherein oxygen containing gas is added to said auxiliary reactor while said distress feed is added to said auxiliary reactor.

2. The process of claim 1 wherein said distress feed is a sludge stream removed from a bottom portion of an oil storage tank.

3. The process of claim 1 wherein said distress feed is a refinery slop oil stream, at least a portion of which is a stable oil/water emulsion and contains particulates.

4. The process of claim 1 wherein said auxiliary reactor is a bubbling dense bed reactor.

5. The process of claim 1 wherein said auxiliary reactor is a riser reactor.

6. The process of claim 1 wherein the sole source of heat in said auxiliary reactor, exclusive of feed preheat, is thermal energy in said regenerated FCC E-Cat.

7. The process of claim 1 wherein said auxiliary reactor comprises means for removal of catalyst from said auxiliary reactor, and for oxidative decoking of said removed auxiliary reactor catalyst in a separate decoking reactor to produce heated, decked auxiliary catalyst which is recycled to said auxiliary reactor.

8. The process of claim 1 wherein cracked product from said FCC reactor is charged to an FCC fractionator for product recovery and vapor product from said auxiliary reactor is charged to said FCC fractionator for product recovery.

* * * * *